US005451735A

United States Patent [19]

Worthington et al.

[11] Patent Number: 5,451,735

[45] Date of Patent: Sep. 19, 1995

[54] FLEXIBLE CIRCUMFERENTIAL SWITCH

[75] Inventors: Montgomery W. Worthington, Santa Cruz; Steven A. Luzovich, Ben Lomond; Christopher R. Kilgus, II, Capitola, all of Calif.

[73] Assignee: Worthington Data Solutions, Santa Cruz, Calif.

[21] Appl. No.: 72,296

[22] Filed: Jun. 3, 1993

[51] Int. Cl.[6] ..... H01H 3/02

[52] U.S. Cl. ..... 200/505; 200/60; 235/462

[58] Field of Search ..... 200/505, 60, 512, 511, 200/516, 517, 239, 245, 246; 235/462, 469, 472

[56] References Cited

U.S. PATENT DOCUMENTS

| | | | |
|---|---|---|---|
| 3,746,814 | 7/1973 | Lackey et al. | 200/505 |
| 4,272,658 | 6/1981 | Crosby | 200/569 |
| 4,492,832 | 1/1985 | Taylor | 200/505 |
| 4,748,319 | 5/1988 | Sasaki et al. | 235/472 |

*Primary Examiner*—Henry J. Recla
*Assistant Examiner*—David J. Walczak
*Attorney, Agent, or Firm*—Skjerven, Morrill, MacPherson, Franklin & Friel; Forrest E. Gunnison

[57] ABSTRACT

A circumferential switch has a flexible electrically conductive band positioned around and separated from an outer circumference of a tubular body so that an air gap is formed between the band and tubular body. The band is electrically connected to a circuit board, contained within the tubular body, by a lead that passes through a circular hole in the tubular body. The circuit board is in electrical contact with the tubular body, which is also electrically conductive. The switch is in a first state in its normal position, i.e., positioned around and separated from the outer circumference of the tubular body. The switch changes states only when any part of the band makes contact with the tubular body. Thus, when the band is depressed by being squeezed, i.e., deflected, the band makes electrical contact with the tubular body, and the switch is in a second state. When pressure on the switch is released, the band returns to its original position and breaks the electrical connection and so the switch returns to the first state.

30 Claims, 6 Drawing Sheets

FLEXIBLE CIRCUMFERENTIAL SWITCH

BACKGROUND OF THE INVENTION

1. Field of the Invention

The invention relates generally to switches used to activate circuitry housed in a tubular device and in particular to a circumferential switch to activate circuitry in a tubular housed electronic device and a method for making the circumferential switch.

2. Description of the Related Art

Most switches on barcode wands and other tubular devices are activated by a single button, key, or some type of actuator that is positioned at a particular location on the scanner body or tube. To activate the switch, as a bar code is scanned, requires an operator to always hold the device at the same position or orientation, and with some designs at the same vertical location. Such a switch does not take into account anatomic variables, and is not as convenient as a circumferential switch.

As its name implies, a circumferential switch wraps around the entire surface of the tubular device, i.e., the circumference, and is positioned in the location typically used to hold the device. The circumferential nature of the switch allows activation of the switch at any rotation, orientation, or angle as the device is used for barcode scanning. The switch is engaged by simply picking up the device like a pencil and lightly squeezing on the switch area.

One circumferential barcode wand switch 100, hereinafter "barcode switch 100" is illustrated in FIG. 1. Barcode switch 100 is available from Welch Allen of Skeneatles Falls, New York. Housing 104 is a cylindrical metal tube that houses bar code scanning circuitry mounted on board 106. A two membrane circuit 110 is mounted to the outer circumference 104A of housing 104 with adhesive on the non circuit side of two membrane circuit 110. Two membrane circuit 110 is mounted near tip 102 of the barcode wand. A rubber cover 103 surrounds a two membrane circuit 110.

Two membrane circuit 110 of barcode switch 100 is made of two clear, flexible, plastic membranes. A pattern is printed with silver conductive ink 212 (FIG. 2) on a surface of each membrane. The membranes are laminated together such that the printed patterns face each other, but are separated from each other by a very small air pocket, referred to as air gap 101 (FIG. 1), that is formed between the two membranes.

A tab 111 (FIGS. 1 and 2) has a first conductor 220 connected to the printed pattern on one membrane and a second conductor 221 connected to the printed pattern on the other membrane. Conductors 220, 221 are insulated from each other so that they do not make electrical contact. Tab 111 extends from the two membranes though a square hole 105 (FIG. 1). As tab 111 extends through hole 105, tab 111 makes a 180 degree bend 107, and is connected to board 106 by electrical connector 108.

When the operator squeezes bar code switch 100 at any point, the air in air gap 101 is compressed and the two printed patterns make electrical contact. The electrical contact is maintained as long as the operator maintains pressure on bar code switch 100. When the pressure is released, bar code switch 100 returns to the original open position.

Unfortunately, while circumferential bar code switch 100 is easier to use than other single location switches, the functionality and durability of bar code switch 100 is poor. The problems that exist are primarily associated with the two printed circuits on the membranes. The two layers of silver conductive ink 212 (FIG. 2) are made up of tiny particles of silver suspended in a printable ink, which when shorted together are neither durable nor reliable. Furthermore, if during assembly, or actual use, the silver conductive ink layers are kinked, scratched, folded, impacted or otherwise harmed, the life expectancy is reduced and may even cause immediate failure of switch 100.

Most failures occur at 180 degree bend 107. If tab 111 is not aligned precisely in square hole 105, or if tab 111 is not a precise length, tab 111 contacts the long flat sharp edges of square hole 105. If membrane circuit 110 is affixed to the metal housing twisted, relative to square hole 105, tab 111 enters square hole 105 at an improper angle. Consequently, the sides and even the conductive ink of tab 111 may be cut by contact with the edges of square hole 105. Thus, production yields are poor, if close attention is not paid to all of these problems.

Unfortunately, a failure may not show up in production inspection, because the cut or damage to tab 111 during assembly may not be sufficient to cause a failure. However, upon use of the device, tab 111 is damaged further and a failure occurs.

If the device is dropped, since square hole 105 is near tip 102, the impact of the tip with an object can result in tab 111 contacting the sharp edge of square hole. Over time, contact between an edge of square hole 105 and tab 111 causes tab 111 to fail. Generally, contact between square hole 105 and tab 111 cuts or wears the conductive ink off, or cuts through tab 111. All of this adds up to a high failure rate of barcode switch 100 both in production and in actual use. Hence, while a circumferential switch is ergonomically preferable, the reliability of such a switch limits its acceptance, and increases manufacturing costs, which in turn increases the cost to the end user.

SUMMARY OF THE INVENTION

According to the principles of this invention, a circumferential switch having a novel band structure that makes electrical contact with the circumference of an electrically conductive body of a device eliminates the problems associated with prior art circumferential switches while maintaining the ergonomic advantages. The circumferential switch of this invention includes (i) an electrically conductive body means having a circumferential surface and (ii) a band means having a first surface and a second electrically conductive surface opposite the first surface. A stainless steel barcode wand is an example of an electrically conductive body means.

The band means is mounted around the circumferential surface of the electrically conductive body means so that the electrically conductive surface of the band means is adjacent to and separated from the circumferential surface by a gap, preferably an air gap, so that the switch is in a first state. The switch is in a second state when the band means is deflected so that a part of the electrically conductive surface of the band means contacts the circumferential surface of the electrically conductive body.

A spacer means fixedly attaches the band means to the circumferential surface of the electrically conductive body. The spacer means defines the size of the gap. By varying the size of the spacer means, the travel and the feel of the circumferential switch of this invention can be varied. In one embodiment, the spacer means is a foam spacer.

The band means includes a backing material means having a first surface and a second surface opposite the first surface, and an electrically conductive material means fixedly attached to the second surface of the backing material means so that a portion of the second surface is electrically conductive. Preferably, the backing material is a dielectric, e.g., a flexible stable plastic. One flexible stable plastic suitable for use in this invention is sold under the U.S. Trademark "KAPTON".

An electrically conductive material means affixed to the second surface of the backing material is, in one embodiment, a metal foil. In another embodiment, the electrically conductive material means affixed to the second surface of the backing material is a metal trace. The metal foil and the metal trace can be any electrically conductive metal such as copper.

To affix either the metal foil or the metal trace to the backing material, the metal is laminated to the backing material. The laminated metal may be plated with a metal selected from the group consisting of gold, tin, nickel, and silver, and is preferably nickel. The plating prevents both corrosion and any galvanic reaction between the metal and the tubular body of a barcode wand.

In one embodiment, the metal trace is a plurality of substantial parallel solid metal lines wherein each line has a first end connected to a first line perpendicular to the plurality of substantially parallel lines and a second end connected to a second line perpendicular to the plurality of substantially parallel lines. This trace pattern provides immunity to the failure mechanisms of the prior art circumferential switches.

The band means is positioned about the tubular body so that a first edge of the band means is approximately adjacent to a tip of the barcode wand and a second edge of the band means is removed from the tip. Also, the tubular body includes a circular hole orientated approximately below the second edge of the band means. An electrical conductor connects the electrically conductive portion of the second surface of the band means to a circuit board contained within the tubular body by extending through the circular hole.

DETAILED DESCRIPTION

Figure 1:
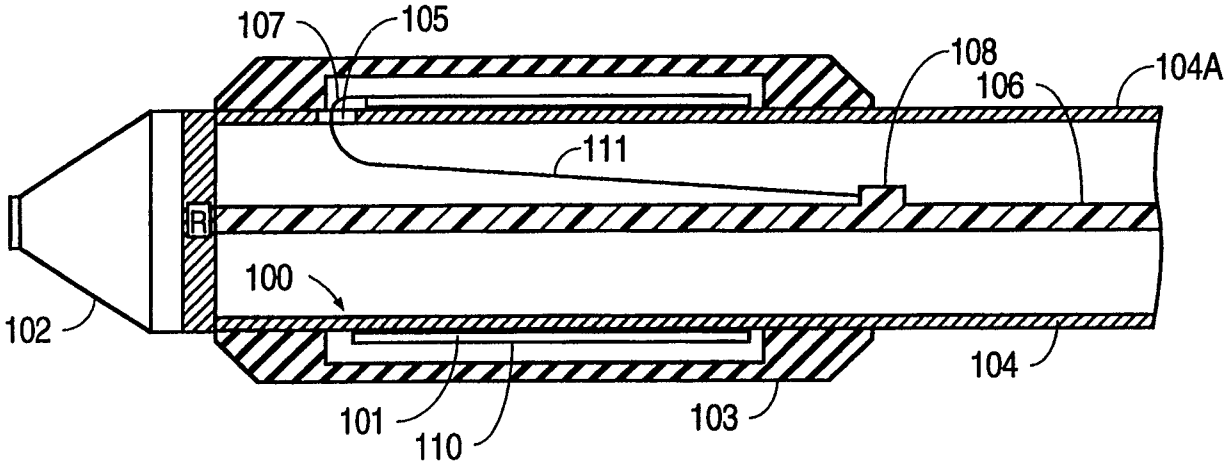
FIG. 1 (PRIOR ART)
FIG. 1 is a cross-sectional view of a prior art barcode wand circumferential membrane switch.
Figure 2:
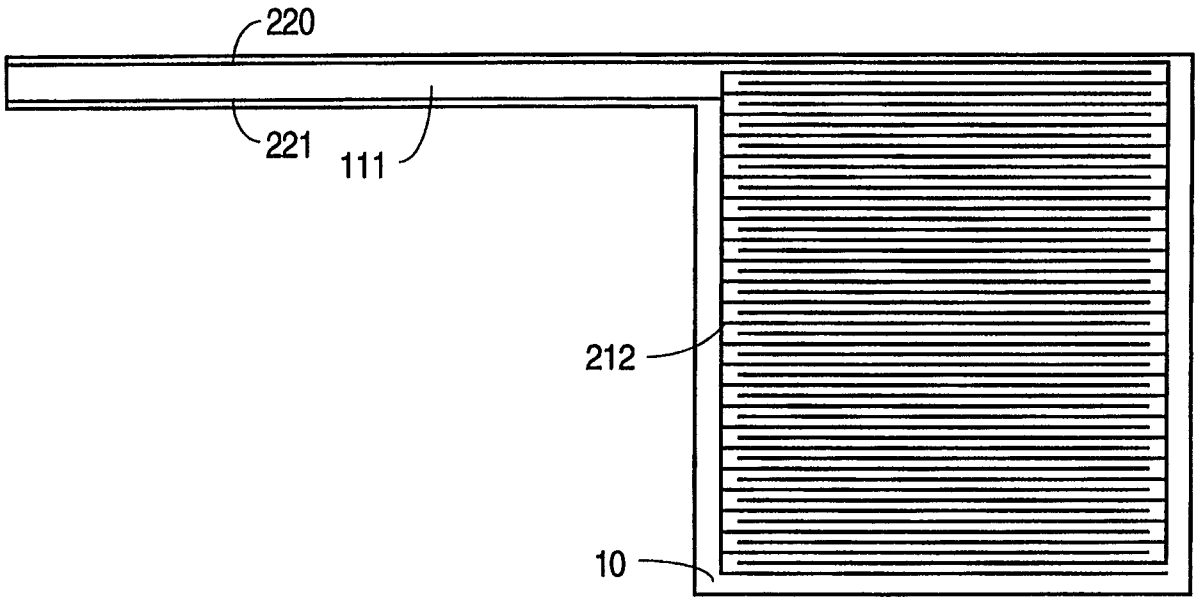
FIG. 2 (PRIOR ART)
FIG. 2 is a prior art plastic membrane switch circuit.
Figure 3:
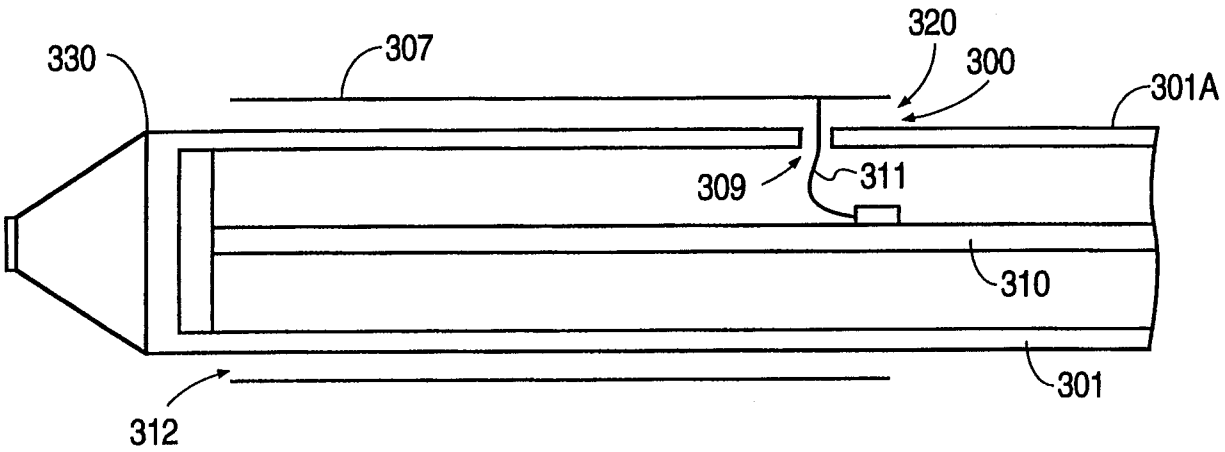
FIG. 3 illustrates the primary components of one embodiment of the circumferential switch of this invention.

According to the principles of this invention, a circumferential switch 300 has enhanced reliability and functionality in comparison to prior art circumferential switch 100 and in addition, is easier to manufacture. A flexible electrically conductive band 307, sometimes referred to herein simply as either "band 307," "flexible band 307," or "conductive band 307," is positioned around and separated from outer circumference 301A of a tubular body 301, so that an air gap 312 is formed between band 307 and tubular body 301. Preferably, band 307 is positioned so that when tubular body 301 is grasped by a user, the user naturally grasps conductive band 307.

Conductive band 307 is electrically connected to a circuit board 310, contained within tubular body 301, by a lead 311 that passes through a circular hole 309 in tubular body 301. Preferably, circular hole 309 is positioned near an edge surface 320 of switch 300 that is most remote from an end 330 of tubular body 301, e.g., approximately below edge surface 320. Circuit board 310 is in electrical contact with tubular body 301, which is also electrically conductive.

Switch 300 is in a first state in its normal position, i.e., positioned around and separated from outer circumference 301A of tubular body 301. Switch 300 changes states only when any part of band 307 makes contact with tubular body 301. Thus, when flexible conductive band 307 of switch 300 is depressed by being squeezed, i.e., deflected, band 307 makes electrical contact with tubular body 301, and switch 300 is in a second state. When pressure on switch 300 is released, flexible conductive band 307 returns to its original position and breaks the electrical connection and so switch 300 returns to the first state. Air gap 312 is maintained by the selection of a high quality flexible band 307 that rebounds back to the original location after thousands of actuations of switch 300.

As explained more completely below, band 307 is made so that if a portion of band 307 is damaged, switch 300 still functions reliably. Unlike prior art switch 100, switch 300 of this invention is immune to failure modes caused by kinking, scratching, or folding of band 307. Hence, switch 300 is more reliable than prior art switch 100 and production yields are better.

As used herein, "flexible" means that the material deforms under normal pressure that can be applied by the fingertips while grasping switch 300, and that the material returns to its original position when the fingertip pressure is released. As explained more completely below, flexible conductive band 307 can be made from a variety of materials.

In one embodiment, flexible conductive band 307 is a metal trace pattern formed on one side of a flexible backing material, as described more completely below. In another embodiment, flexible conductive band 307 is a solid metal strip that is fixedly attached to one side of a backing material. For example, one surface of the backing material can be laminated to a metal foil. The thickness of the metal foil can range from about 0.0005 inches (0.0127 mm) to about 0.010 inches (0.254 mm) and preferably ranges from about 0.001 inches (0.0254 mm) to about 0.003 inches (0.0762 mm) and most preferably is about 0.00135 inches (0.0343 mm) or 1 ounce (28.4 gms) type foil.

Any flexible stable plastic, flexible paper, or other flexible type of durable dielectric backing material can be used as the backing material. The flexible dielectric backing material chosen preferably withstands high temperatures, is substantially chemically inert, and environmentally stable. Specifically, the dielectric backing material should withstand temperatures encountered in soldering, for example, temperatures as high as 275° C. to 300° C. Also, the dielectric backing material should not be affected by processes or conditions encountered either in the manufacturing process or in the use of circumferential switch 300, i.e., the material should be substantially chemically inert. The thickness of the flexible dielectric backing material can range from about 0.0005 inches (0.0127 mm) to about 0.0050 inches (0.127 mm) and preferably ranges from about 0.0010 inches (0.0254 mm) to about 0.0020 inches (0.0508 mm) and most preferably is about 0.0010 inches (0.0254 mm).

Figure 4:
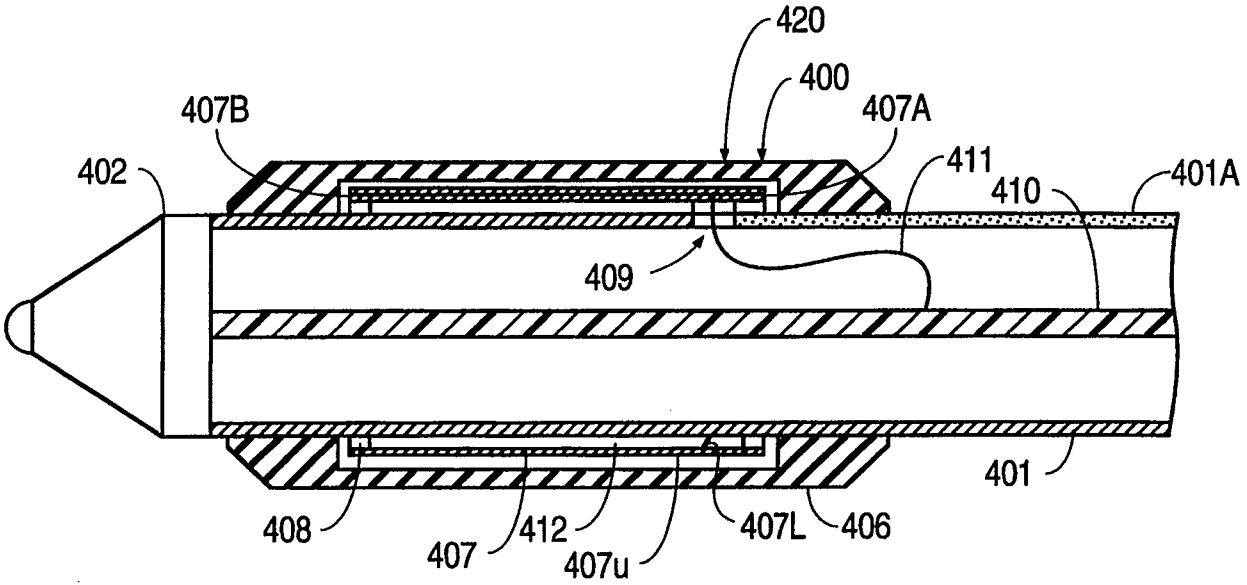
FIG. 4 shows a detailed cut away assembly view of one embodiment of a barcode scanner circumferential switch according to the principles of the invention.

In one embodiment of this invention, flexible circumferential bar code switch 400 (FIG. 4) uses as flexible band 407 a copper trace pattern 521 (FIG. 5) that is laminated to one side of a flexible insulating dielectric film 520. One flexible insulating dielectric film suitable for use in this invention is sold by E. U. Dupont de Nemours & Company under the registered United States trademark, "KAPTON" This dielectric backing material is widely available in the electronics industry.

In this embodiment, rectangular copper trace 522 surrounds entire active switch area 525. Active switch area 525 is defined by copper trace pattern 521 that includes a plurality of substantially parallel solid lines that are contained with rectangular copper trace 522. Each of the parallel lines has a first end that contacts edge 522A of rectangular copper trace 522, i.e., a first line that is perpendicular to the substantially parallel line, and a second end that contacts edge 522B of rectangular copper trace 522, i.e., a second line that is perpendicular to the substantially parallel lines. Each of the parallel lines has a thickness "t" of about 0.010 inches (0.254 mm), and is separated from the adjacent parallel line by a spacing "s" of about 0.010 inches (0.254 mm).

A single solder pad 523 is provided at a corner 522× of rectangular copper trace 522. Notice that, in this embodiment, each of the parallel lines has at least two paths to solder pad 523, i.e., a plurality of paths to solder pad 523. Copper trace 521 is formed from a copper foil using conventional photolithography technology, i.e., image and resist, that is well known to those skilled in the art. Copper foil is readily available pre-laminated to a dielectric backing material, or the copper foil can be laminated separately. The thin dielectric backing material supports and protects the copper foil during manufacturing. Further, the dielectric backing material acts as an etch resist when the trace pattern is formed in the copper foil during the photolithography imaging process.

In one embodiment, after the trace is formed in the copper foil, the copper trace is plated to prevent the copper from oxidizing and/or galvanically reacting with the conductive tubular housing. Many different plating materials can be used including tin, nickel, gold, and silver. Preferably, a flash plating of nickel over the copper is used, because nickel is not significantly reactive with stainless steel housing 401, is the most cost effective, and allows for reliable soldering.

Length x (FIG. 5) of conductive band 407 ranges from about 0.5 inches (1.27 cm) to about 2.0 inches (5.08 cm) and is preferably about one inch (2.54 cm). The actual length is selected to provide desired active switch area 525. If length x is about one inch, active switch area 525 closely matches the grip of human fingers and maximizes durability and switch feel.

Flexible conductive band 407 (FIG. 4) is affixed to conductive tubular body 401 by a foam spacer 408. Foam spacer 408 is resilient so that foam spacer 408 is not compressed by repeated actuations of switch 400. In this embodiment, foam spacer 408 is die cut from foam tape with adhesive on both sides. One foam tape with double sided adhesive suitable for use in this invention is sold by 3M Corporation as Brand 4921/4920.

A first portion of the die cut piece of the foam tape is affixed adjacent to edge 407B of flexible conductive band 407 and a second portion of the die cut piece of the foam tape is affixed adjacent to edge 407A of flexible conductive band 407. Margins 530 and,531 have a width that is approximately equal to the cut width of the pieces of foam tape. In one embodiment, this width is about 0.050 inches (1.27 mm). Another thin strip about 0.050 inches (1.27 mm) of the die cut foam tape is affixed adjacent to edge 407C of flexible conductive back 407. The foam strip along edge 407C acts as a guide for the wire to solder pad 523, and protects the corner of flexible conductive band 407 from going into hole 409. The three foam strips are all die cut and placed on flexible conductive band 407 at the same time in this embodiment. During the die cutting, the outline has a cutaway area to allow the wire to pass through the foam spacer to solder pad 523.

Flexible conductive band 407 with foam spacer 408 is subsequently positioned around, i.e., wrapped around, and affixed to tubular body 401. Thus, band 407 has a first surface 407U and an electrically conductive second surface 407L opposite first surface 407U. Band 407 is mounted around circumferential surface 401A of tubular body 401 so that electrically conductive second surface 407L is adjacent to circumferential surface 401A, but yet conductive second surface 407L is separated from circumferential surface 401A by air gap 412.

Figure 5:
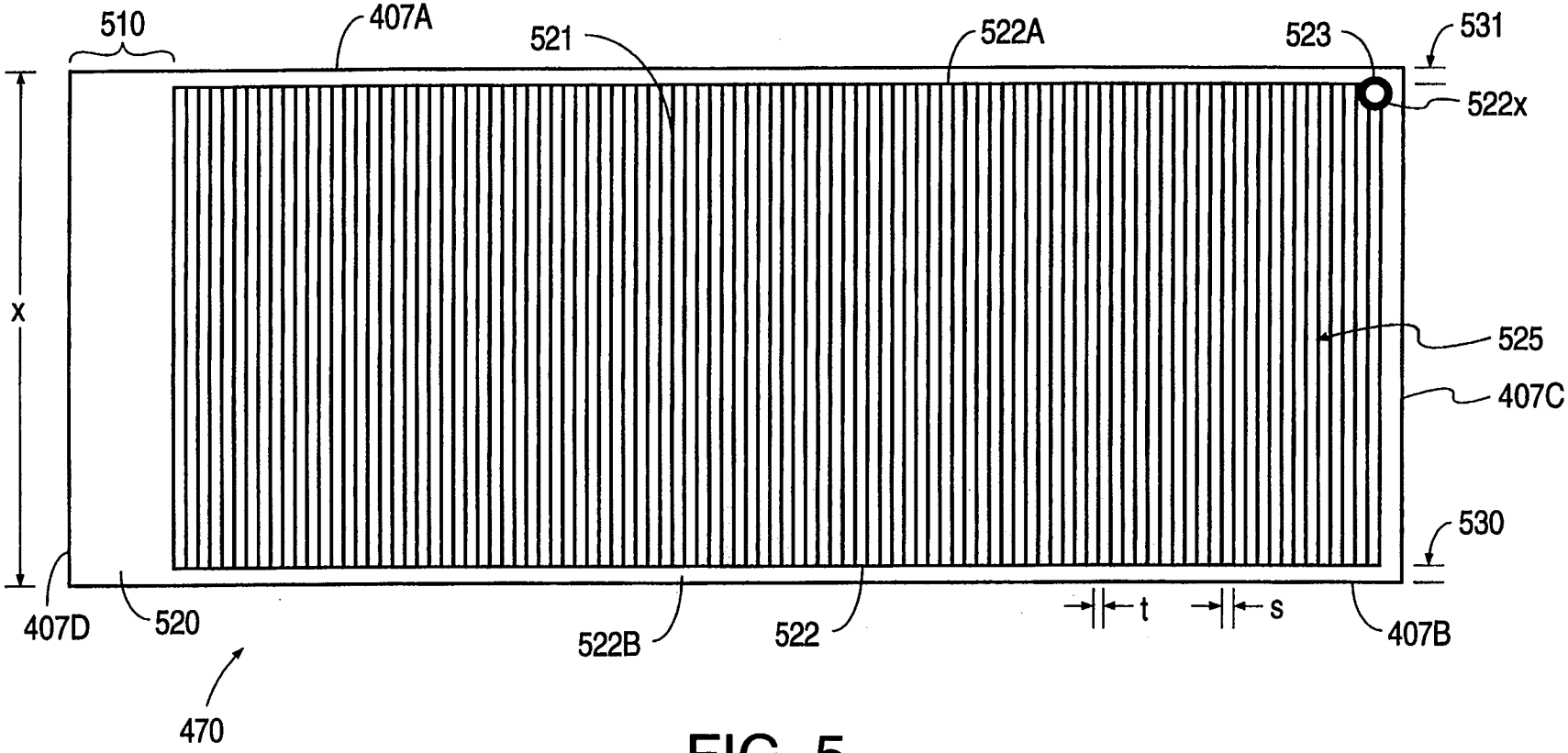
FIG. 5 shows one embodiment of the flexible band of the switch in FIG. 4 according to the principles of this invention.

To prevent band 407 from unwrapping, an acrylic adhesive is placed on an adhesive margin of surface 407U of flexible conductive band 407 at end 407C (FIG. 5). When flexible conductive band 407 is placed around tubular body 401 so that the foam spacer contacts tubular body 401, end 407D extends over the adhesive on surface 407U and is pressed to surface 407U to make contact with the adhesive.

The adhesive margin determines the size of margin 510. In this embodiment, a margin 510 of 0.150 inches (3.81 mm) was used. However, margin 510 can be in the range of 0.050 inches (1.27 mm) to double the effective circumference of flexible conductive band 407.

The use of the foam spacer along edge 407C creates a thin 0.050 inch (1.27 mm) dead spot in switch 400. However, the dead spot is undetectable and is necessary for the support and overlapping of band 407. In this embodiment, flexible conductive band 407 is positioned at or near wand tip 402, which is the natural location to grasp a barcode wand for barcode scanning.

The 3M brand 4921/4920 foam tape provides an air gap 412 of approximately 0.015 inches (0.381 mm). Other air gap dimensions could be used to change the sensitivity and travel of switch 400.

Flexible band 407 is connected to circuit board 410 inside tubular body 401 by a wire 411 that is soldered to solder pad 523. In this embodiment, wire 411 is 28 gauge copper wire, which is a stranded copper wire with a diameter of about 0.030 inches (0.762 mm). Teflon insulated wire is preferred because the teflon insulation resists insulation shrink back during soldering and provides a tough insulation that resists cuts and abrasion. While in this embodiment, a wire is used to connect band 407 to circuit board 410, a variety of connectors could be used including, for example, metal foil or a male connector pin that passes through hole 409 and mates with a precisely positioned female socket or connector on board 410.

Wire 411 passes through a small round hole 409, e.g., a hole having a diameter of about 0.100 inches (2.54 mm), in tubular body 401. Hole 409 is placed at end 420 of switch 400 that is furthest removed from wand tip 402 to prevent damage to wire 411 and band 407.

Tubular body 401 can be made of any electrically conductive material such as an electrically conductive high impact plastic or a metal tube. In this embodiment, a stainless steel tube was used for tubular body 401 for cost savings, durability and ease of manufacturing.

Finally, flexible band 407, connecting wire 411, and round hole 409 in tubular body 401 are all covered by a switch cover 406. Switch cover 406 is bonded to tubular body 401 with adhesive to hold switch cover 406 in position and to seal and protect band 407 as well as wand circuit board 410. Switch cover 406 can be made from urethane, silicone, rubber, or any other similar material that rebounds quickly to hold its original shape and provides a comfortable surface to hold. In one embodiment, switch cover 406 was molded from nitrile rubber.

Figure 6:
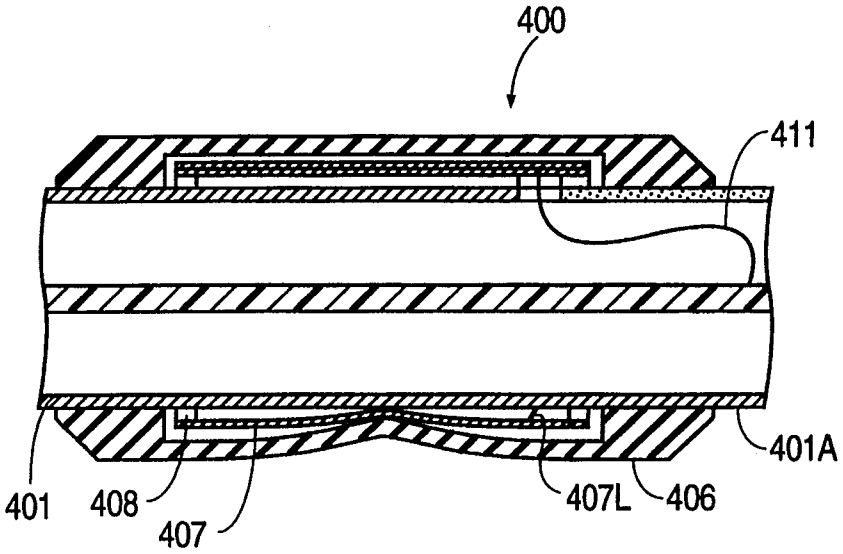
FIG. 6 shows a detailed cut away view of the circumference switch of FIG. 4 with one side depressed to show activation as it pertains to the teachings of the invention.

When flexible band 407 is actuated, i.e., sufficiently deformed, to contact electrically conductive tubular body 401, metal trace 521 on side 407L of band 407 makes contact with electrically conductive tubular body 401 (FIG. 6). This contact completes a monitored electrical circuit that turns the barcode wand on. In addition, in some cases, switch 400 provides a path for primary power, directly switching the wand on. After switch 400 is released, or the grip is relaxed, rubber boot 406 and flexible conductive band 407 return to their original position thereby switching the wand to its "off" state.

In our invention, if an individual copper trace in active switch area 525 (FIG. 5) is somehow damaged, switch 400, as a whole, does not fail. Rather, a very small non-active area, equal in size to the cut area, is created. Such damage is not easily detected by the user, since switch 400 is typically deformed at two locations, 180 degrees apart, by the grip of fingers creating two large areas of contact during use. The elimination of single trace sensitivity is accomplished by using trace 522 that surrounds entire active switch area 525 and connecting every trace back to single solder pad 523. When a single trace is cut, the cut has no effect on the overall function of band 407. Only if a large number of traces are cut or have multiple cuts does band 407 fail in a large area. A failure of this type is very unlikely with the materials and design used, other components in the wand would fail far before either a failure of a large number of traces or the entire band 407. Thus, switch 400 of this invention has superior reliability and durability, both short term and long term, in comparison to prior art circumferential switches.

The embodiments disclosed herein of the novel circumferential switch of this invention are illustrative only and are not intended to limit the invention to the specific embodiments described. In view of this disclosure, those skilled in the art can implement the circumferential switch in a wide variety of applications. Further, a plurality of such switches could be used on a single device.

We claim:

1. A switch comprising:

a electrically conductive body having an exterior circumferential surface wherein said electrically conductive body houses an electronic circuit; and a band having a first non-electrically conductive surface and a electrically conductive second surface opposite said first surface; wherein said band is fixedly mounted around said exterior circumferential surface of said electrically conductive body so that said electrically conductive second surface is adjacent to and separated from said exterior circumferential surface of said electrically conductive body by a gap so that said switch is in a first state; and upon deflecting said band by depressing said first non-electrically conductive surface so that a part of said electrically conductive second surface contacts said exterior circumferential surface of said electrically conductive body, said switch is in a second state.

2. The switch of claim 1 further comprising a spacer mounted to said electrically conductive surface and to said exterior circumferential surface so as to form said gap and fixedly attaches said band to said exterior circumferential surface.

3. The switch of claim 2 wherein said spacer comprises a foam spacer.

4. The switch of claim 1 wherein said band includes a backing material that forms said first non-electrically conductive surface.

5. The switch of claim 4 wherein said backing material is a dielectric.

6. The switch of claim 5 wherein said dielectric backing material is a flexible stable plastic.

7. The switch of claim 6 wherein said flexible stable plastic is sold under the U.S. Trademark "KAPTON".

8. The switch of claim 4 wherein said band further comprises a metal foil laminated to said backing material so that said metal foil is said electrically conductive second surface of said band.

9. The switch of claim 4 wherein said band further comprises a metal trace pattern laminated to said backing material so that said metal trace pattern is said electrically conductive second surface of said band.

10. The switch of claim 9 wherein said metal trace pattern comprises a plurality of substantial parallel lines wherein each line has a first end connected to a first line perpendicular to said plurality of substantially parallel lines and a second end connected to a second line perpendicular to said plurality of substantially parallel lines.

11. The switch of claim 9 wherein the metal trace pattern is copper.

12. The switch of claim 11 wherein the copper is plated with a metal selected from the group consisting of gold, tin, nickel, and silver.

13. The switch of claim 12 wherein the metal is nickel.

14. A circumferential barcode switch for a bar code wand having (1) a electrically conductive tubular body, hereinafter tubular body, with a circumferential outer surface, and (2) a circuit board contained within and electrically connected to said tubular body, said circumferential barcode switch comprising:

a band including:

a backing material having a first surface and a second surface opposite said first surface; and a electrically conductive material fixedly attached to said second surface of said backing material so that a portion of said second surface is electrically conductive; and a spacer fixedly attached to said circumferential outer surface of said tubular body and to said second surface wherein said second surface is positioned by said spacer around said circumferential outer surface of said tubular body so that said second surface is adjacent to and separated from said tubular body by a gap so that said circumferential barcode switch is in first state; and upon deflecting said backing material so that a part of said electrically conductive portion of said second surface contacts said tubular body said circumferential barcode switch is in a second state.

15. The circumferential barcode switch of claim 14 wherein said spacer comprises of a foam spacer.

16. The circumferential barcode switch of claim 14 wherein said backing material is a dielectric.

17. The circumferential barcode switch of claim 16 wherein said dielectric backing material is a flexible stable plastic.

18. The circumferential barcode switch of claim 17 wherein said flexible stable plastic is sold under the U.S. Trademark "KAPTON".

19. The circumferential barcode switch of claim 14 wherein said electrically conductive material further comprises a metal foil.

20. The circumferential barcode switch of claim 19 wherein said metal foil is laminated to said backing material.

21. The circumferential barcode switch of claim 19 wherein said metal foil is a copper foil.

22. The circumferential barcode switch of claim 14 wherein said electrically conductive material further comprises a metal trace pattern.

23. The circumferential barcode switch of claim 22 wherein said metal trace pattern is laminated to said backing material.

24. The circumferential barcode switch of claim 22 wherein said metal trace pattern comprises a plurality of substantial parallel lines wherein each line has a first end connected to a first line perpendicular to said plurality of substantially parallel lines and a second end connected to a second line perpendicular to said plurality of substantially parallel lines.

25. The circumferential barcode switch of claim 22 wherein the metal trace pattern is copper.

26. The circumferential barcode switch of claim 25 wherein the copper is plated with a metal selected from the group consisting of gold, tin, nickel, and silver.

27. The circumferential barcode switch of claim 26 wherein the metal is nickel.

28. The circumferential barcode switch of claim 14 wherein said band is positioned about said tubular body so that a first edge of said band is approximately adjacent to a tip on one end of said electrically conductive tubular body and a second edge of said band is removed from said tip.

29. The circumferential barcode switch of claim 28 wherein said tubular body includes a circular hole orientated approximately below said second edge of said band.

30. The circumferential barcode switch of claim 29 further comprising a electrical conductor connecting said electrically conductive portion of said second surface to said circuit board and extending through said circular hole.

* * * * *